US005692482A

United States Patent [19]

Shimizu et al.

[11] Patent Number: 5,692,482

[45] Date of Patent: Dec. 2, 1997

[54] IGNITION COIL FOR INTERNAL COMBUSTION ENGINE

[75] Inventors: Takeshi Shimizu; Koji Waki; Shigemi Murata; Masaaki Taruya; Mitsuru Koiwa; Toshio Maekawa, all of Hyogo, Japan

[73] Assignee: Mitsubishi Denki Kabushiki Kaisha, Tokyo, Japan

[21] Appl. No.: 606,763

[22] Filed: Feb. 27, 1996

Related U.S. Application Data

[63] Continuation of Ser. No. 206,832, Mar. 7, 1994, abandoned.

[30] Foreign Application Priority Data

Jul. 9, 1993 [JP] Japan ..... 5-169978

[51] Int. Cl.[6] ..... F02P 3/02

[52] U.S. Cl. ..... 123/634; 361/268

[58] Field of Search ..... 123/634, 647; 336/96, 107; 361/268

[56] References Cited

U.S. PATENT DOCUMENTS

| | | | |
|---|---|---|---|
| 4,248,201 | 2/1981 | Tsutsui et al. | 123/647 |
| 4,509,033 | 4/1985 | Weiss et al. | 336/96 |
| 4,918,419 | 4/1990 | Ida | 336/107 |
| 5,003,959 | 4/1991 | Umezaki et al. | 123/634 |
| 5,153,550 | 10/1992 | Sugiura et al. | 336/107 |
| 5,186,154 | 2/1993 | Takaishi et al. | 123/647 |
| 5,359,982 | 11/1994 | Taruya | 123/634 |
| 5,364,279 | 11/1994 | Betz et al. | 336/107 |

FOREIGN PATENT DOCUMENTS

| | | | |
|---|---|---|---|
| 0440395 | 8/1991 | European Pat. Off. . | |
| 4132153 | 4/1992 | Germany . | |
| 4102145 | 7/1992 | Germany . | |
| 5-87034 | 4/1993 | Japan . | |
| 1544087 | 4/1979 | United Kingdom | 336/96 |

OTHER PUBLICATIONS

Patent Abstracts of Japan, vol. 17, No. 480, [E1425], Aug. 31, 1993, for JP 5-121252 (Inagaki), May 18, 1993.

*Primary Examiner*—Andrew M. Dolinar

*Attorney, Agent, or Firm*—Sughrue, Mion, Zinn, Macpeak & Seas, PLLC

[57] ABSTRACT

Wirings on the low-tension side which are comprised of a terminal connected to a primary winding, terminals of an electronic component, and terminals of connectors electrically connected to external devices are formed as a unit by means of a molding and formed as an insert assembly 13, and electrical connections of the respective terminals are established by welding. An arrangement is provided such that the primary winding and the insert assembly are electrically connected by fusing, are then bent and accommodated in a case.

4 Claims, 4 Drawing Sheets

IGNITION COIL FOR INTERNAL COMBUSTION ENGINE

This is a Continuation of application Ser. No. 08/206,832 filed Mar. 7, 1994, now abandoned.

BACKGROUND OF THE INVENTION

This invention relates to an ignition coil for an internal combustion engine, and more particularly to a low-voltage connecting means of this ignition coil.

FIG. 9 is a plan view illustrating a conventional ignition coil for an internal combustion engine. In the drawing, reference numeral 1 denotes a closed path-type core a part of which passes through a main body; 2, a primary bobbin which is arranged in such a manner as to surround a portion of this core 1 and around which a conductive wire is wound; 3, a primary winding which is a conductive wire wound around this primary bobbin; 4, a secondary bobbin which is arranged in such a manner as to surround this primary winding 3 and around which a conductive wire is wound; 5, a secondary winding which is a conductive wire wound around this secondary bobbin 4, and whose number of turns is approximately 100 times that of the primary winding 3; 6, a terminal attached to the secondary bobbin 4 and electrically connected to a low-tension end of the secondary winding 5; 7, an electronic component in which a high-tension end of the secondary winding 5 is wound around one of its lead terminals and is electrically connected thereto by soldering; and 8, a case for accommodating the primary bobbin 2, the secondary bobbin 4, and the electronic component 7. Numerals *9a*, *9b*, and *9c* denote terminals of connectors which are pressure fitted in this case 8 for establishing electrical connections with external devices, a portion of the remaining wire of the primary winding 3 being wound around the terminal 6 and electrically connected as it is to the terminal *9a* by soldering. The terminals *9b* and *9c* are electrically connected to the lead terminals of the terminal component 7 by soldering.

FIG. 10 is a cross-sectional side elevation of FIG. 9. In the drawing, numeral 10 denotes a high-tension terminal attached to the case 8 so as to lead a high voltage to the outside; 11, a lead wire for leading the high voltage from the high-tension end of the secondary winding 5 to the high-tension terminal 10; and 12, a resin member provided for the secondary bobbin 4 so as to hold the lead wire 11.

Next, a description will be given of the operation.

The electronic component 7 undergoes an on-off operation in response to a signal input from an external device via the terminal *9b*. When the electronic component 7 is turned on, and energization of the primary winding 3 is started via the terminal *9a*, the primary winding 3 generates a magnetic flux, and this magnetic flux passes through the core 1 and crosses the secondary winding. Then, when an off signal is input to the electronic component 7, the electronic component 7 instantly cuts off the energization to the primary winding 3, so that the magnetic flux which crossed the secondary winding 5 decreases abruptly. Then, the aforementioned change in the magnetic flux causes a high voltage corresponding to the turn ratio between the primary winding 3 and the secondary winding 5 to be generated at the end of the secondary winding 5 in accordance with the rule of electromagnetic inductance. This high voltage is then supplied to the outside via the lead wire 11 and the high-tension terminal 10.

Since the conventional ignition coil is arranged as described above, there have been problems in that the remaining wire of the conductive wire of the primary winding must be used for the internal wiring, which requires an intricate manual operation and makes automation difficult, and that even if the wiring is replaced by a terminal, the number of components used increases and the number of connecting points also increases. Furthermore, interconnections of terminals by means of soldering involve much time, and an increase in the number of connecting points substantially affects the cost. Additionally, since the primary winding has an insulating coating, an operation for removing the insulating coating mechanically or chemically prior to electrical connection is conventionally required, resulting in the problem of higher cost.

SUMMARY OF THE INVENTION

The present invention has been devised to overcome the above-described problems, and its object is to obtain an ignition coil having low-tension-side electrical connections which are compact, low-cost, and highly reliable.

In the ignition coil for an internal combustion engine in accordance with the present invention, a structure adopted is such that the wiring on the low-tension side and terminals of connectors are formed as a unit by a resin, and interconnections between the terminals are effected by welding, and an interconnection between the low-tension-side wiring and the primary winding is effected by fusing, and the fused portion of this wiring is bent in the case.

The low-tension-side wirings in the present invention are produced at low cost by being formed as a unit, the number of connecting points is reduced, and the number of assembling processes is reduced. In addition, accurate positioning of each wiring becomes possible, the arrangement contributes to the automation of assembly and connection and further to the production of a compact ignition coil, and reliability improves. Also, the welding of the wirings on the low-tension side and the connection of the primary winding through fusing shortens processing time and reduces the processing cost. Since the structure adopted is such that the primary winding of the integrated wirings and the fused portion are bent and accommodated in the case, the fusing portion can be disposed at a position higher than other welded connecting points, so that a free working space can be provided in a surrounding portion of the fusing portion, which facilitates the operation up to fusing and a compact size becomes possible. In addition, since a resin wall is provided between at least two or more welded connecting points between a group of terminals of an electronic component and the low-tension-side wirings which are in close proximity to each other, short-circuiting due to welding slag can be prevented, so that reliability improves.

BRIEF DESCRIPTION OF PREFERRED EMBODIMENTS

DETAILED DESCRIPTION OF PREFERRED EMBODIMENTS

First Embodiment

Figure 1:
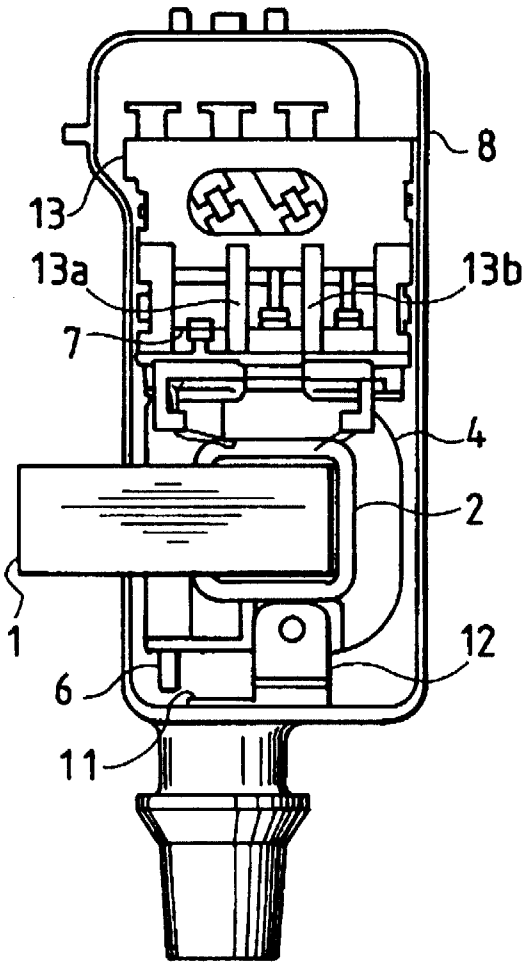
FIG. 1 is a plan view illustrating an ignition coil for an internal combustion engine before mold-injection in accordance with an embodiment of the present invention.

Referring now to the drawings, a description will be given of an embodiment of the present invention.

Figure 2:
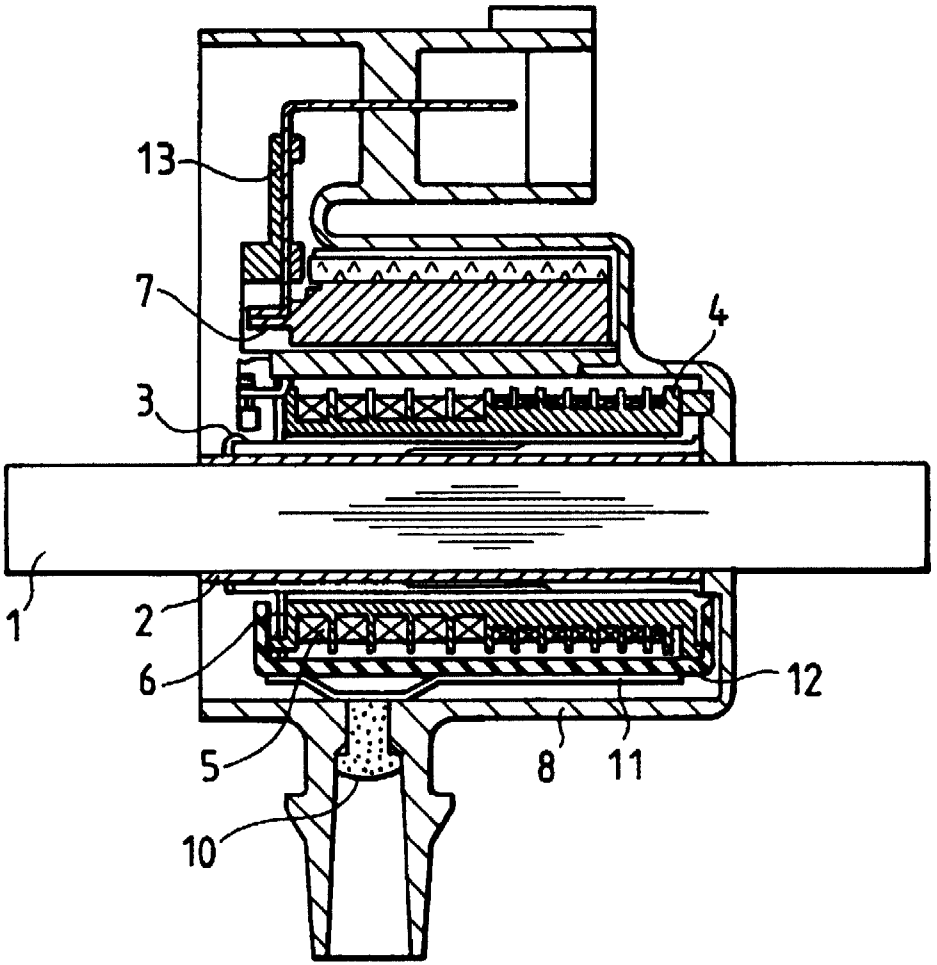
FIG. 2 is a cross-sectional side elevation view illustrating the ignition coil for an internal combustion engine in accordance with the embodiment of the present invention.
Figure 3:
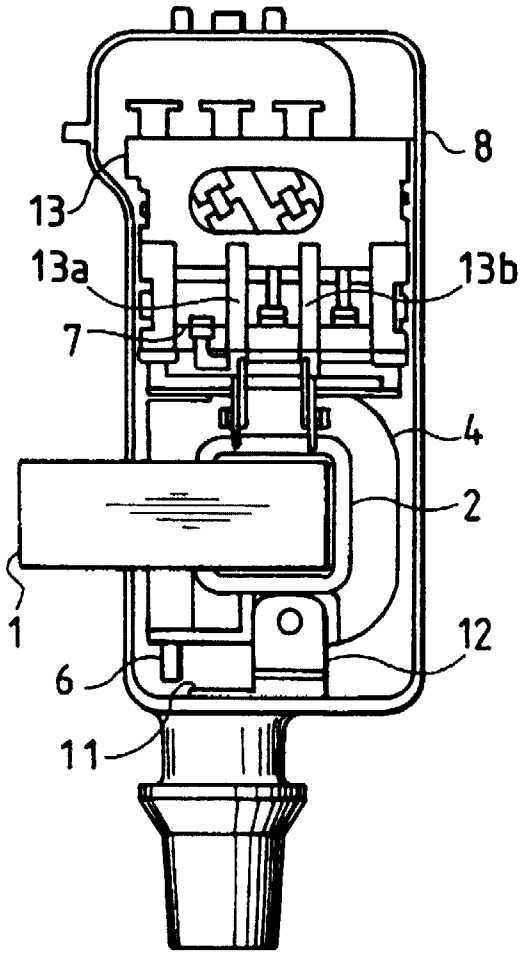
FIG. 3 is a plan view illustrating the ignition coil for an internal combustion engine before the bending of a fusing portion after fusing in accordance with the embodiment of the present invention.
Figure 4:
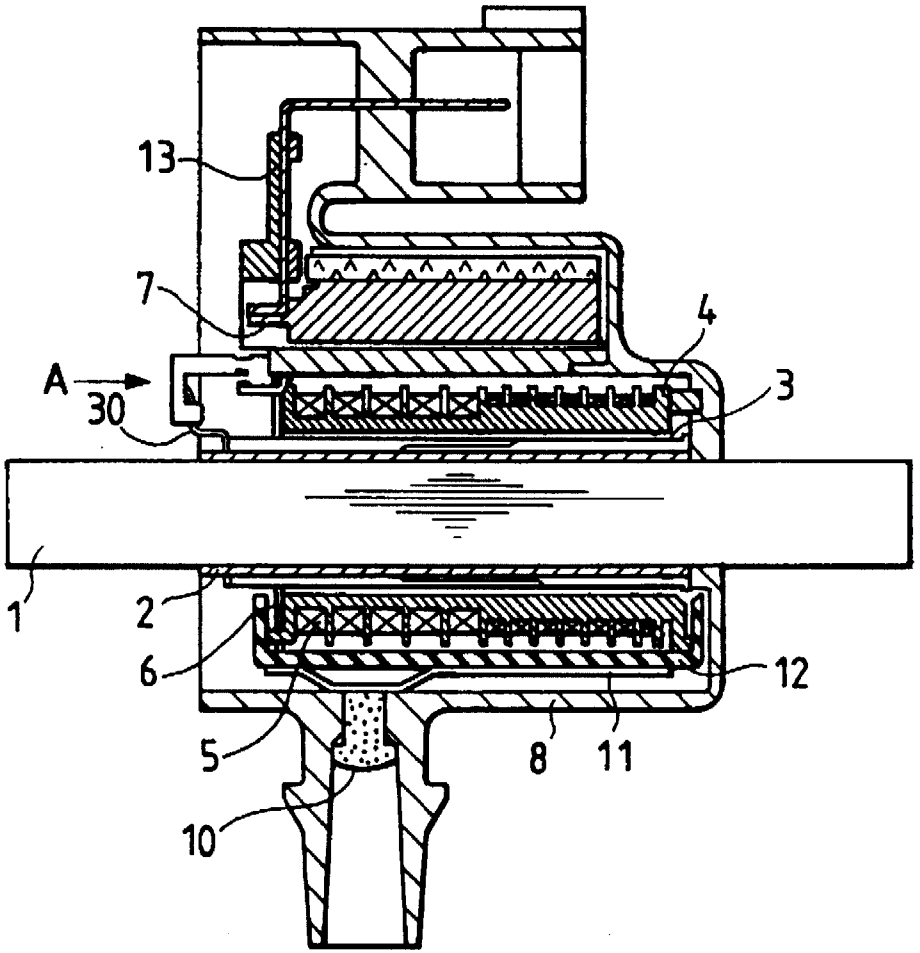
FIG. 4 is a cross-sectional side elevation view illustrating the ignition coil for an internal combustion engine before the bending of the fusing portion after fusing in accordance with the embodiment of the present invention.

In FIGS. 1 and 2, reference numeral 1 denotes a closed magnetic path-type core a portion of which passes through a main body; 2, a primary bobbin which is arranged in such a manner as to surround a portion of this core 1 and around which a conductive wire is wound; 3, a primary winding which is a conductive wire wound around this primary bobbin; 4, a secondary bobbin which is arranged in such a manner as to surround this primary winding 3; 5, a secondary winding which is a conductive wire wound around this secondary bobbin 4, and whose number of turns is approximately 100 times that of the primary winding 3; 6, a terminal attached to the secondary bobbin 4 and electrically connected to a high-tension end of the secondary winding 5; 7, an electronic component; and 8, a case for accommodating the primary bobbin 2, the secondary bobbin 4, and the electronic component 7; 13, an insert assembly which is fixed in this case, and in which a group of conductors 13*c* connected to the terminal 6, lead terminals of the electronic component 7, and the winding end of the primary winding 3 by means of welding or fusing and jointly using terminals of connectors for establishing electrical connections with external devices are formed as a unit by means of a resin 13*d*. In the electrical connection of a primary winding end 3*a*, in which case positioning is most indefinite and difficult among the terminal 6, the electronic component 7, and the primary winding 3 that are electrically connected to the insert assembly 13, a step in the height-wise (vertical) direction is provided at a portion A with respect to other welded connecting points so as to secure a sufficient working space in its surrounding portion, and the primary winding end 3*a* is electrically connected to the insert assembly 13 by means of fusing. This stepped portion is offset by being bent, as shown in FIG. 2, before the mold-injection of a resin 50 after the fusing operation.

Figure 7:
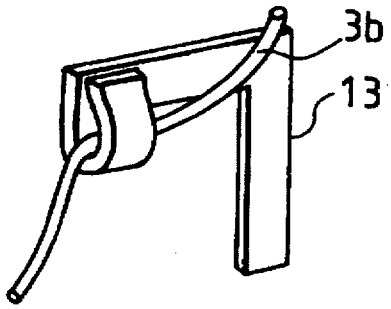
FIG. 7 is a detailed diagram of the fusing portion in accordance with the embodiment of the present invention.
Figure 8:
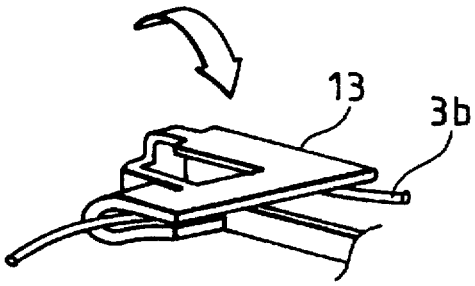
FIG. 8 is a detailed diagram of the bending of the fusing portion in accordance with the embodiment of the present invention.
Figure 9:
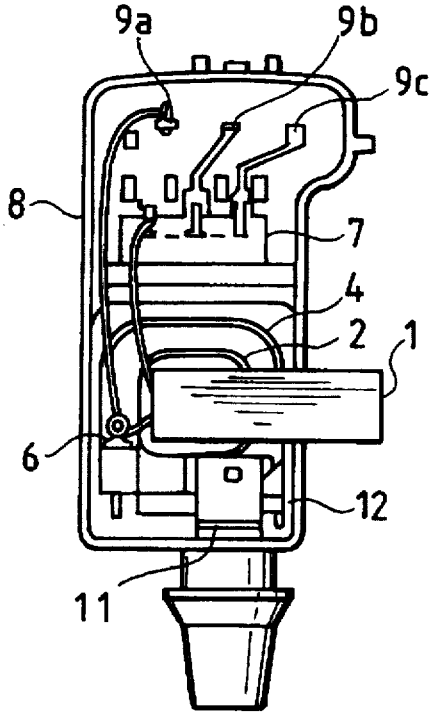
FIG. 9 PRIOR ART
FIG. 9 is a plan view illustrating a conventional ignition coil for an internal combustion engine prior to mold-injection.
Figure 10:
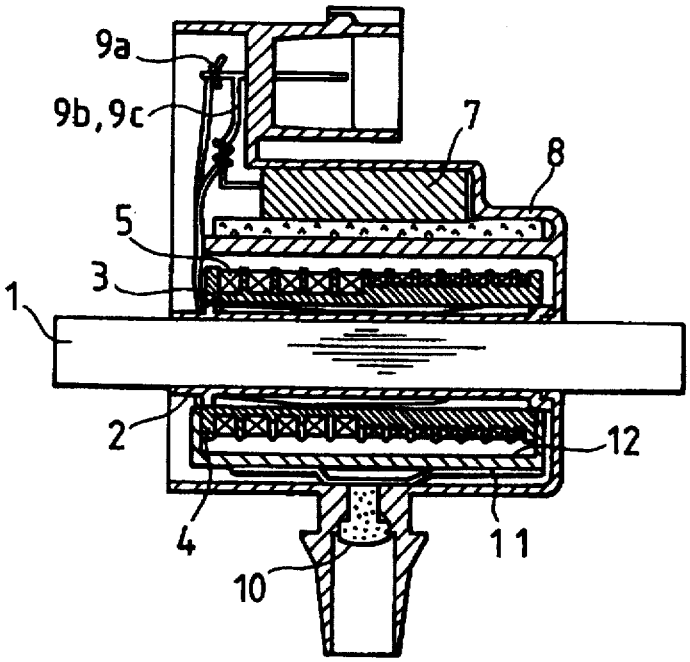
FIG. 10 PRIOR ART
FIG. 10 is a cross-sectional side elevation view illustrating the conventional ignition coil for an internal combustion engine prior to mold-injection.

Reference numeral 3*b* shown in FIG. 7 denotes a remaining wire portion of the primary winding 3 after the fusing operation. This remaining wire portion 3*b* is not required to be removed by cutting, and the structure adopted is such that even if it is slightly long, the remaining wire portion 3*b* is pressed from above at the bending portion after the fusing operation of the insert assembly 13, as shown in FIG. 8, so that the remaining wire portion 3*b* will not project outside the case 8.

Then, in FIG. 2, numeral 10 denotes a high-tension terminal attached to the case 8 so as to lead a high voltage to the outside; 11, a lead wire for leading the high voltage from the high-tension end of the secondary winding 5 to the high-tension terminal 10; and 12, a resin member provided for the secondary bobbin 4 so as to hold the lead wire 11.

Figure 5:
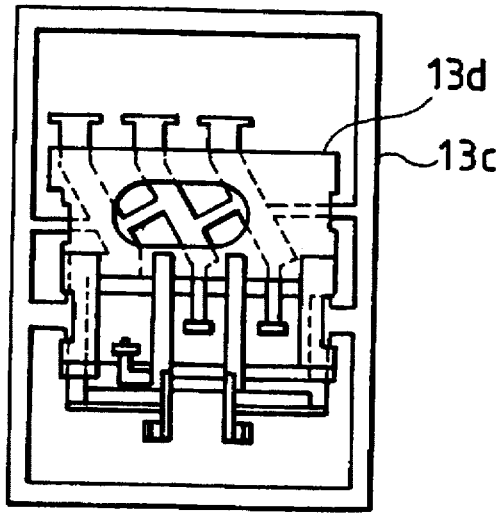
FIG. 5 is a diagram illustrating a state after conductors of an insert assembly are formed integrally by means of a resin in accordance with the embodiment of the present invention.
Figure 6:
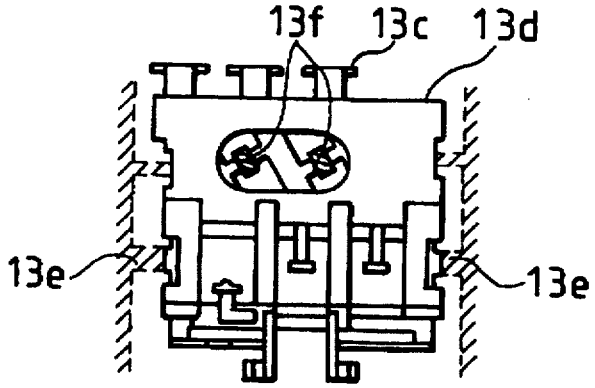
FIG. 6 is a diagram illustrating a state after unnecessary conductor portions of the insert assembly are removed by cutting in accordance with the embodiment of the present invention.

This insert assembly 13 is fabricated integrally such that after each wiring arrangement is formed of a single metal plate by press working, and the periphery of this group of wirings is formed by the resin 13*d*, as shown in FIG. 5, the conductors 13*c* are cut off at portions 13*e* and 13*f*, as shown in FIG. 6, in conformity with the functions of the wirings. Further, this insert assembly 13 has resin walls 13*a* and 13*b* for preventing short-circuiting between the terminals due to welding slag produced during the welding of the group of conductors 13*c* with the group of terminals of the electronic component 7.

Next, a description will be given of the operation the electronic component 7 undergoes on-off operations in response to signals input to the insert assembly 13 by the external devices. When the electronic component 7 is turned on, and the energization of the primary winding 3 is started via the insert assembly 13, the primary winding 3 generates a magnetic flux, and this magnetic flux passes through the core 1 and crosses the secondary winding 5. Then, when an off signal is inputted to the electronic component 7, the electronic component instantly cuts off the energization of the primary winding 3, so that the magnetic flux which crossed the secondary winding 5 suddenly decreases. Then, the change in the magnetic flux generates at the secondary winding 5 end a high voltage corresponding to the turn ratio between the primary winding 3 and the secondary winding 5 in accordance with the law of electromagnetic induction. Subsequently, this high voltage is supplied to the outside via the lead wire 11 and the high-tension terminal 10.

As described above, in accordance with the present invention, since the wirings on the low-tension side are integrated by a resin, there are advantages in that the ignition coil can be produced at low cost and that a compact ignition coil can be obtained.

In accordance with the present invention, since the electrical connections on the low-tension side are effected by welding, the processing time is short, that the ignition coil can therefore be produced at low cost, and that a highly reliable ignition coil can be obtained.

In accordance with the present invention, there are advantages in that the number of processes can be reduced since a fusing technique is employed in which, in the connection of the primary winding 3 and the group of conductors 13*c*, the insulating coating of the primary winding 3 is eluted and removed by heating the conductors by allowing a large current to flow therethrough by means of a caulking electrode, which permits direct caulking, that the ignition coil can therefore be produced at low cost, and that a highly reliable ignition coil can be obtained.

In accordance with the present invention, since the arrangement provided is such that the connections between the primary winding and the wiring are bent after connection, there is an advantage in that a sufficient space is secured for the connection, thereby facilitating the operation.

In accordance with the present invention, since walls for preventing the short-circuiting of the connecting points due to welding slag by means of the resin constituting an integral wiring on the low-tension side are provided between at least two or more welded connecting points between the group of terminals of the electronic component and the integrated wiring on the low-tension side, there is an advantage in that even if the ignition coil is made compact, a highly reliable ignition coil can be obtained at low cost.

What is claimed is:

1. An ignition coil for an internal combustion engine comprising:

a winding for the ignition coil;

an electronic component for controlling a current flowing through the winding, said electronic component being integrally formed with said winding; and an insert assembly, having a plurality of rigid conductors which provide for direct electrical connections to said winding, terminals of said electronic component, and connector terminals for connection with external devices, integrally formed by means of a resin.

2. An ignition coil as claimed in claim 1, wherein said conductors are connected by welding.

3. An ignition coil for an internal combustion engine as claimed in claim 1, wherein an end of said winding and a terminal of a conductor are connected by fusing technique in which the conductor is heated by a large current flowing into the conductor.

4. An ignition coil for an internal combustion engine as claimed in claim 1, further comprising a resin wall, for preventing short-circuiting between terminals which is produced by welding slag, between conductor terminals of said insert assembly, said conductor terminals being electrically connected to at least two terminals of said electronic component.

* * * * *